United States Patent [19]

Magin

[11] Patent Number: 4,590,683

[45] Date of Patent: May 27, 1986

[54] METHOD OF AND APPARATUS FOR DRYING WOUND FIBER OR YARN

[75] Inventor: Berthold Magin, Hassloch, Fed. Rep. of Germany

[73] Assignee: MTM Obermaier GmbH & Co. KG, Hassloch, Fed. Rep. of Germany

[21] Appl. No.: 658,196

[22] Filed: Oct. 5, 1984

[30] Foreign Application Priority Data

Oct. 8, 1983 [EP] European Pat. Off. ..... 83110084.7

[51] Int. Cl.[4] ..... F26B 5/04

[52] U.S. Cl. ..... 34/1; 34/21; 34/92; 34/104; 34/15; 34/68

[58] Field of Search ..... 34/15, 92, 68, 104, 34/21, 1

[56] References Cited

U.S. PATENT DOCUMENTS 3,010,216 11/1961 Ravet ..... 34/15
3,631,691 1/1972 Karrer ..... 34/104
4,075,765 2/1978 Karrer ..... 34/104

FOREIGN PATENT DOCUMENTS 1315445 5/1973 United Kingdom .

*Primary Examiner*—Larry I. Schwartz

*Attorney, Agent, or Firm*—Toren, McGeady, Stanger, Goldberg & Kiel

[57] ABSTRACT

Fiber or yarn wrapped on spools is dried in a pair of vessels in an alternating gas flow arrangement. Each vessel is located in a separate circulation loop. The two circulation loops have a common circulation leg. Each of the circulation loops is connected to an evacuation device via an evacuation duct. The evacuation duct contains valves for selective connection of the evacuation duct to one or the other circulation loops. The common circulation leg contains a blower, a heater, a connection for introducing moisture into the gas used in the circulation loops, a cooler and a moisture separator. Valve controlled bypasses are connected to each of the circulation loops and to the common circulation leg so that a selected flow of heating gas can be provided in one of the loops when it is being evacuated. High frequency heaters are arranged in each of the vessels for supplying additional heat to the fiber or yarn. While heating gas flows in one circulation loop, the other circulation loop is connected to the evacuation device for completing the drying operation. The circulation loops alternate between flowing heating gas and evacuating the vessel in the loop.

9 Claims, 1 Drawing Figure

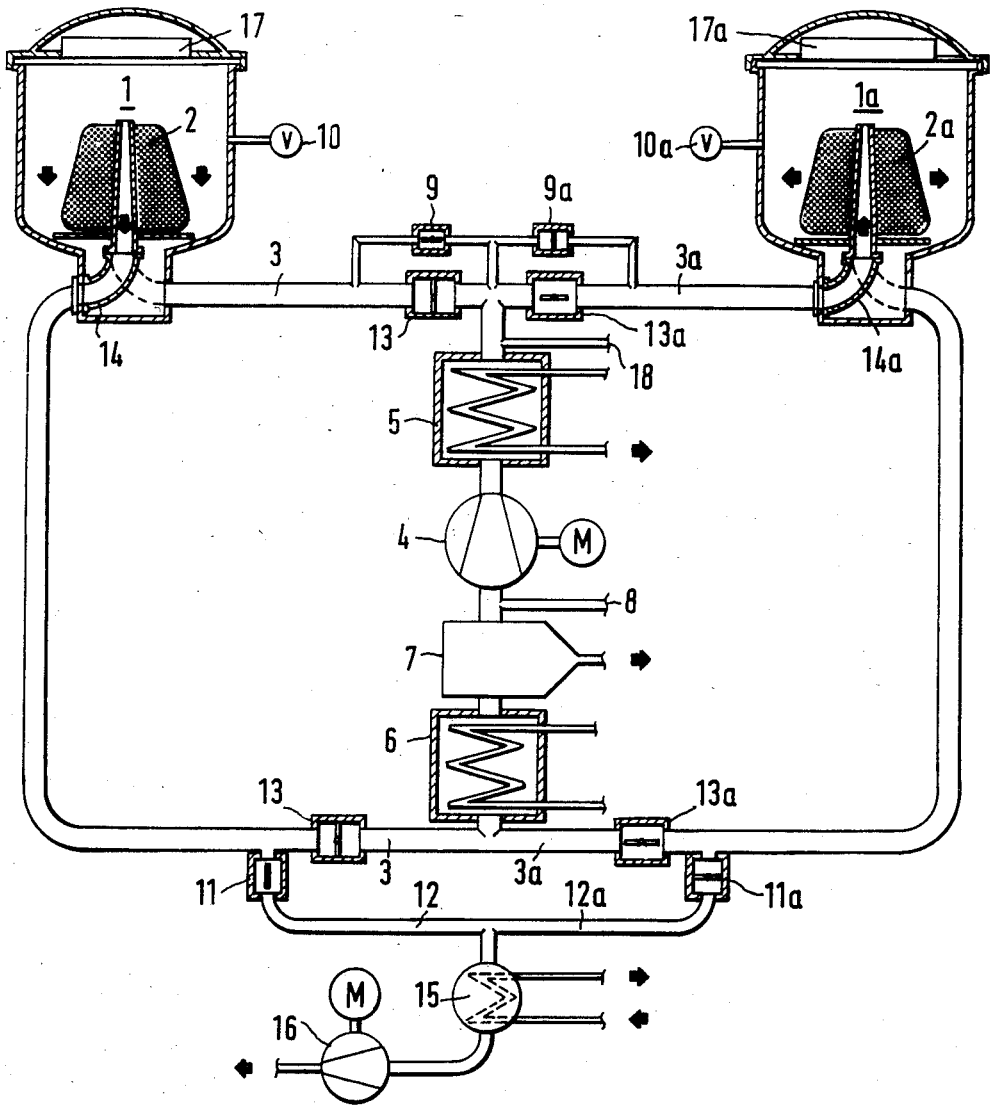
17
17a
1
1a
2
2a
10
10a
V
9
9a
3
3a
13
13a
14
14a
18
5
4
M
8
7
6
11
11a
12
12a
15
16

METHOD OF AND APPARATUS FOR DRYING WOUND FIBER OR YARN

BACKGROUND OF THE INVENTION

The present invention is directed to a method of drying fiber or yarn wound on spools with said spools located in two separate vessels so that the drying operation alternates between the two vessels. In the drying procedure, the fiber or yarn is heated with an approximately moisture-saturated heated gas which serves as the heat carrier in the first part of the drying operation and, after the heating, a vacuum is established in the vessel for completing the drying. The steps of the drying procedure are carried out alternately in the two vessels until final drying is achieved. Further, the present invention is directed to the apparatus for carrying out the drying procedure.

Such a drying procedure, as well as the apparatus for performing the procedure is known, for example, German Patentshrift 21 07 696 corresponding to Great Britain Pat. No. 1,315,445. The drying procedure is effected by circulating a gas serving as a heat carrier which is first humidified during the heating process for heating the fiber or yarn to 30° to 60° C. To reduce the drying effect of the gas, the moistening or humidification of the gas is so intense that the partial steam pressure is approximately equal to the partial steam pressure of the gas boundary layer at the capillary surface of the goods being dried and the partial steam pressure is, in turn, dependent on the temperature of the goods being dried corresponding to the steam curve. Accordingly, an intensive heating of the textile goods is obtained and at the same time drying of the goods is avoided. Subsequently, the vessel containing the goods is evacuated causing the boiling point to be lowered with the moisture in the fiber or yarn being evaporated and evacuated or drawn off by a vacuum pump. The drying procedure alternating between heating with a moist hot vapor or gas and subsequently drying by means of a vacuum is repeated until the fiber or yarn is sufficiently dried.

The use of a moist hot gas or vapor for heating the fiber or yarn is an unconditional prerequisite for its safe treatment. When a hot dry gas is used the drying time is reduced, however, there is the problem of irreparable damage to the fiber or yarn because of overdrying.

Since the heating and vacuum drying steps must be performed alternately, as mentioned, the known drying apparatus employs a pair of vessels in which the drying procedure is carried in an alternating manner. The two vessels are connected to a humidifying heating device and to an evacuating drying device by means of reversing valves. As a result, the drying process can be carried out in the two vessels at the same time using a single arrangement of a heater, a blower or fan, and an evacuating device including a condenser, since when the blower and heater are connected to one of the vessels and other vessel is connected to the evacuating device.

In practice it has been noted that the drying procedure using a vacuum comes to a halt rather rapidly. This occurs when the moisture located at the outer surface of the fiber or yarn wound on the spool is evaporated. The moisture contained in the inner layers, spaced inwardly from the surface of the spool evaporates due to the reduction in the boiling point, however, the steam diffuses very slowly through the intermediate layers to the surface layer. Tests have shown that the drying procedure comes to a stop after about one-sixth of the time required for the entire drying cycle.

SUMMARY OF THE INVENTION

The primary object of the present invention is to improve the method of and apparatus for drying so that the moisture stored in the inner layers of the fiber or yarn in the spools can be more effectively removed thereby shortening the overall drying procedure.

In accordance with the present invention, the moisture content of the gas effecting the heating of the fiber or yarn is reduced corresponding to the moisture content in the fiber or yarn during the first part of the drying procedure. As a result, the duration of the second part of the drying procedure is shortened by moving the residual moisture within the fiber or yarn on the spool to the outer surface by introducing a flow of the heating gas into the vessel during the drying operation so that an intermediate pressure is established.

In an advantageous embodiment of the invention, the heating gas flow can be supplied intermittently into the vessel during the vacuum drying operation. Such an arrangement is particularly advantageous if the capacity of the evacuation device or vacuum pump is limited.

A particular advantage of the present invention is that the moisture contained in the inner layers of fiber or yarn on the spool reaches the outer surface not only due to diffusion, but also due to the aid of the gas flow introduced during the vacuum drying operation.

In accordance with the invention, the reduction in the boiling point in the vessel is maintained and, at the same time, safe treatment of the fiber or yarn is assured.

Another feature of the invention is the establishment of the time required for the drying operation in one vessel to correspond to the time required for heating the fiber or yarn in the other vessel whereby there is a considerable reduction in the cycle time required for the complete drying of the fiber or yarn and a reduction of the entire treatment period.

Another feature of the present invention involves the use of apparatus which affords a satisfactory, disturbance-free shortened operating cycle without involving any additional expensive equipment.

This feature of the invention is achieved by inserting between the valves controlling flow through the vessels, in addition to a blower, a heater and means for introducing moisture into the gas, a cooler and a water or liquid separator and valve bypasses for the selective flow of heating gas into the vessels during the vacuum drying step.

In another advantageous embodiment of the invention, the cooler is a heat exchanger. Furthermore, a high frequency or microwave heater can be incorporated into the vessels to enhance the drying procedure particularly under the effect of a partial or complete vacuum.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

BRIEF DESCRIPTION OF THE DRAWING

The drawing is a schematic illustration of the apparatus embodying the present invention.

DETAILED DESCRIPTION OF THE INVENTION

In the drawing a pair of closed vessels 1, 1*a* are shown each containing at least one spool 2, 2*a* of fiber or yarn to be dried. For purposes of this description, vessel 1 will be characterized as the first vessel and vessel 1*a* as the second vessel. First vessel 1 is positioned in a first heating loop 3 and second vessel 1*a* is located in a second heating loop 3*a*. An evacuation duct is connected to each of the first and second circulation loops with an evacuation duct section 12 connected to the first circulation loop 3 and a second evacuation duct section 12*a* connected to the second circulation loop 3*a*. The first and second circulation loops 3, 3*a* each have a common circulation leg 3*b*.

Valves 13 are located in the first circulation loop 3 and valves 13*a* are located in the second circulation loop 3*a* so that with one pair of valves closed and the other pair open flow is blocked through one circulation loop and is admitted through the other circulation loop. Note in the drawing that the valves 13 are in the closed position and the valves 13*a* are in the open position so that there is no flow from the common leg 3*b* into the first circulation loop 3, however, flow from the common leg can pass through the second circulation loop 3*a*.

In the common leg 3*b* there is a blower 4 for circulating a gas or vapor through the circulation loops and a heater 5 disposed in the path of the gas flowing from the blower into one or the other of the circulation loops. A compressed air source 8 is connected to the common leg 3*b* on one side of the blower 4 and a connection 18 for introducing moisture into the gas flow is located on the downstream side of the heater. As a rule, saturated steam is used to provide moisture in the heating gas being directed through the blower into the circulation loops.

The evacuation duct formed by the duct sections 12, 12*a* has a common leg containing an evacuation device 16, such as a vacuum pump with a condenser 15 located between the evacuation device and the evacuation duct sections 12, 12*a*. Each of the vessels 1, 1*a* has an aeration and ventilation valve 10, 10*a*, respectively, connected to it. The first vessel 1 and the second vessel 1*a* each have a switching element 14, 14*a* arranged so that the spools 2, 2*a* carrying the fiber or yarn can be dried at the inside or the outside, as desired.

As viewed in the drawing, a first bypass line 9 is connected to the first circulation loop 3 and a second bypass line 9*a* is connected to the second circulation loop 3*a* with the two bypass loops having a common leg communicating with the common leg 3*b* of the circulation loops. In other words, the common leg of the two bypass lines is connected to the circulation loops between the valves 13, 13*a* in the upper runs of the circulation loops 3, 3*a*. Each of the bypass lines is valved so that flow can be directed selectively around the valve 13 in the first circulation loop or the valve 13*a* in the second circulation loop. These bypass lines 9, 9*a* can be used to divert a part of the heating gas flowing from the common leg 3*b* into the one of the first and second circulation loops in which the evacuation device is active for effecting drying in the corresponding vessel.

In accordance with the present invention, the drying process is carried out in the following manner. After the wet spools 2, 2*a* of fiber or yarn are taken from the dye works and inserted into the first and second vessels 1, 1*a*, water is removed initially mechanically with compressed air and then the spools are heated using hot moist gas. The blower 4 directs the gas, generally air, through the heater 5 where it is heated and then downstream of the heater where moisture may be introduced into the gas through the connection 18. In operation, the hot moist gas is directed to one of the first and second vessels 1, 1*a*. As shown in the drawing, the flow from the common leg is blocked by the valve 13 from flowing into the first circulation loop 3 so that it passes through the valve 13*a* into the second circulation loop 3*a* and flows into the vessel 1*a* circulating through the spool 2*a*. If the gas is too hot or contains too much moisture, after its removal from the vessel and flow through the second circulation loop it can be cooled in the cooler 6 and water or liquid can be removed in the separator 7 before the gas is reintroduced into the blower 4. The cooling or dehumidifying of the gas is effected in accordance with the drying degree of the fiber or yarn on the spools 2,2*a*. The specific control means for determining the heat or the moisture content of the fiber or yarn within the vessel is not disclosed, since such means are well known to persons skilled in the art.

The heating cycle being carried out in the second vessel 1*a* lasts for about six minutes. The heating step is carried out with approximately moisture-saturated air at about 125° C. when colored cotton or polyester is being treated. Due to the short heating cycle period, the textile product wound on the spool is not heated to any damaging extent with the maximum temperature being about 85° C. though the heated gas is at a higher temperature. The value of temperature depends of the value of moisture.

During the same period that the heating step is being carried out in the second vessel 1*a*, the valves 11, 11*a* in the evacuation duct are positioned so that the evacuation device 16 is connected to the first vessel 1 with the valves 13 in the first circulation loop being closed. As a result, while the heating step is carried out in the second vessel 1*a*, vacuum drying is being effected in the first vessel 1.

When the heating cycle in the second vessel 1*a* is completed, the valves 13, 13*a* in the first and second cooling loops are reversed and the vacuum valves 11, 11*a* in the evacuation sections 12, 12*a* are also reversed so that the flow from the blower 4 is directed into the first circulation loop 3 and the first vessel 1 for flow around the loop through the vessel and back into the common leg 3*b* so that the spool 2 in the first vessel is heated and the second circulation loop 3*a* is connected to the evacuation device so that vacuum drying is carried out in the second vessel 1*a*. In other words, while the heating cycle is carried out in one vessel and the corresponding circulation loop, the vacuum drying is effected in the other vessel and its corresponding circulation loop.

As mentioned above, the drying operation using a vacuum comes almost to a standstill after a relatively short time, that is, approximately one minute. This stoppage in the drying action occurs because the moisture located at the outer surface of the fiber or yarn spool first evaporates and the moisture located in the inner layers on the spool must gradually defuse to the surface before it can be dried. To expedite the diffusion process, the bypass 9*a* is opened slightly after approximately one minute. A part of the heating gas or air flowing through the common leg 3*b* is allowed to flow through the bypass into the vessel 1*a* causing an intermediate pressure to be produced. The flow of the heating gas passes through the fiber or yarn spool 2*a* causing the moisture contained in the inner layers to move to the outer surface where it is evaporated due to the reduction in the boiling point present in the vessel. The evaporated moisture is carried through the circulation loop 3*a* and flows through the vacuum condenser 15. The flow direction through the fiber or yarn spool 2, 2*a* can be adjusted by means of the switching elements 14, 14*a* so that predominantly the flow is directed from th outside to the inside.

In the event the evacuation device or vacuum pump 16 has a high power output, the bypasses 9, 9*a* can be kept open during the vacuum drying operation. If the vacuum pump 16, however, has only a relatively limited power output, it is recommended that the bypass 9, 9*a* in the loop undergoing vacuum drying is alternately opened and closed so that the intermediate pressure in the vessel is maintained at the desired value.

To reinforce the drying procedure, particularly during the vacuum drying operations, a high frequency or microwave heater 17, 17*a*, is associated with each of the first and second vessels 1, 1*a*.

The arrangement of the cooler 6 and the water separator 7 has still another advantage. It is possible to supply cooling water to the vacuum condenser 15 at about 10° C. so that it leaves the condenser at about 35° C. This cooling water is then introduced directly to the cooler 6 in the common leg 3*b* for cooling and dehumidifying the gas flowing through the leg. The cooling water can be removed at the output side of the cooler 6 at a temperature of approximately 60° C. This heated water can then be used as process water, for instance in the connected dye works.

While specific embodiments of the invention have been shown and described in detail to illustrate the application of the invention principles, it will be understood that the invention may be embodied otherwise without departing from such principles.

I claim:

1. Method of drying fiber or yarn wound on spools in a vessel comprising the steps of alternately heating, using an approximately moisture-saturated gas, and vacuum drying the fiber or yarn on the spools in the vessel whereby first the contents of the vessel are heated and subsequently, after terminating the heating step, the contents are then vacuum dried, wherein the improvement comprises the steps of during the heating step adjusting the moisture content of the heating gas in correspondence with the moisture content of the fiber or yarn being heated, and during the vacuum drying step, after drying the outer layer of the fiber or yarn on the spool, for a limited time intermittently introducing a flow of the moisture-saturated heating gas into the vessel while continuing the vacuum drying step for effecting an intermediate pressure in the vessel relative to the vacuum drying pressure whereby due to the introduction of the flow of the heating gas while continuing vacuum drying moisture located inwardly of the surface layer of the fiber or yarn on the spool is moved to the outer surface layer for facilitating the vacuum drying step until the drying step is completed.

2. Method as set forth in claim 1, including the steps of heating and vacuum drying being carried out alternately in a first vessel and in a second vessel whereby while heating is being effected in one of the first and second vessel, vacuum drying is being effected in the other one of the first and second vessels.

3. Method, as set forth in claim 2, wherein adjusting the heating operation and the vacuum drying operation so that the time for effecting each operation is substantially the same.

4. Method, as set forth in claim 1, including the step of mechanically removing moisture from the fiber or yarn on the spool by flowing heated compressed air into the vessel.

5. Apparatus for drying fiber or yarn wound on spools comprising a circulation loop, a circulation leg in said loop, a vessel located in said circulation loop spaced from said circulation leg, an evacuation duct connected to said circulation loop at a location spaced from said circulation leg, an evacuating device connected to said evacuation duct for establishing a vacuum within said vessel, a condenser located in said evacuation duct between said evacuation device and the location of the connection of said evacuation duct to said circulation loop, valve means in said evacuation duct for controlling communication between said evacuation duct and said circulation loop, valves in said circulation loop with said valves selectively admitting or blocking flow through said circulation loops from said circulation leg, a blower located in said circulation leg for circulating gas selectively through said circulation loop, a heater located in said circulation leg for heating the gas, means for introducing moisture into the gas flow in said circulation leg, a cooling device located in said circulation leg for cooling the gas flowing therethrough, means in said circulation leg for separating moisture from the gas flowing therethrough, a bypass connected to said circulation loop and said circulation leg around one of said valves, to provide flow communication between said circulation leg and said circulation loop when the one of said valves blocks flow from said circulation leg into said circulation loop, and a control valve in said bypass for controlling flow therethrough.

6. Apparatus, as set forth in claim 5, wherein said cooler is a heat exchanger.

7. Apparatus, as set forth in claim 5, wherein a high frequency or microwave heater is positioned in the said vessel.

8. Apparatus, as set forth in claim 5, wherein a switching element is associated with said vessel for selectively directing the flow of heating gas within said vessel through the spools therein.

9. Apparatus as set forth in claim 5, wherein aid circulation loop comprises a first circulation loop and a second circulation loop, each of said circulation leg and said evacuation duct being common to said first and second circulation loops, said vessel comprises a first vessel located in said first circulation loop and a second vessel located in said second circulation loop with said first and second vessels being spaced from the connection of said common circulation leg to said first and second circulation loops respectively, said valves comprise first valves located in said first circulation loop and second valves located in said circulation loop with said first and second valves arranged for selectively admitting or blocking flow through the corresponding said first and second circulation loops from or into said common circulation leg, said bypass comprises a first bypass connected to said common circulation and said first circulation loop and a second bypass connected to said second circulation loop and to said common circulation leg and said control valve comprises a first control valve in said first bypass and a second control valve in said second bypass for selectively controlling flow through said first and second bypasses into said first and second circulation loops.

* * * * *